US007959377B2

(12) United States Patent
Pidgeon

(10) Patent No.: US 7,959,377 B2
(45) Date of Patent: Jun. 14, 2011

(54) METHOD OF PREPARING A FOUNDATION STRUCTURE

(76) Inventor: John Terry Pidgeon, Pretoria (ZA)

( * ) Notice: Subject to any disclaimer, the term of this patent is extended or adjusted under 35 U.S.C. 154(b) by 576 days.

(21) Appl. No.: 11/916,807

(22) PCT Filed: Jun. 7, 2005

(86) PCT No.: PCT/IB2005/051846
§ 371 (c)(1),
(2), (4) Date: Jun. 10, 2008

(87) PCT Pub. No.: WO2006/131787
PCT Pub. Date: Dec. 14, 2006

(65) Prior Publication Data
US 2009/0169307 A1 Jul. 2, 2009

(51) Int. Cl.
*E02D 3/11* (2006.01)

(52) U.S. Cl. ..... 405/131

(58) Field of Classification Search ..... 405/131, 405/130, 229
See application file for complete search history.

(56) References Cited

U.S. PATENT DOCUMENTS

| | | | | | |
|---|---|---|---|---|---|
| 3,830,069 | A | * | 8/1974 | Lin | 405/131 |
| 3,868,825 | A | * | 3/1975 | Boyce | 405/131 |
| 4,019,331 | A | | 4/1977 | Rom et al. | 61/53.54 |
| 4,617,744 | A | * | 10/1986 | Siddoway et al. | 34/168 |
| 5,181,797 | A | | 1/1993 | Circeo, Jr. et al. | 405/131 |
| 5,378,086 | A | * | 1/1995 | Campbell et al. | 405/131 |
| 5,838,880 | A | * | 11/1998 | Brooks et al. | 405/131 |

* cited by examiner

*Primary Examiner* — Frederick L Lagman
(74) *Attorney, Agent, or Firm* — Ladas & Parry, LLP

(57) ABSTRACT

This invention provides a method of preparing a foundation structure including the steps of forming foundation trenches in the ground; and heating the ground defining the trenches sufficiently to irreversibly change the properties of the ground defining the trenches. In the case where the ground consists primarily of clay, it is heated to a temperature above a level where the ground is baked into a brick-like consistency, wherein the structural water of crystallisation is removed and any carbonaceous material and Fe is oxidised. If the ground consists primarily of sand, it is heated to a temperature above its vitrification point wherein mullite ($Al_6Si_2O_{13}$) begins to form. The method includes the further step of pre-treating the ground by adding an additive such as potash or slaked lime to the soil, prior to the step of heating.

41 Claims, 3 Drawing Sheets

METHOD OF PREPARING A FOUNDATION STRUCTURE

INTRODUCTION AND BACKGROUND TO THE INVENTION

This invention relates to a method of preparing a foundation structure, a foundation structure prepared by such a method and an apparatus used for preparing such a foundation structure.

U.S. Pat. No. 5,181,797 discloses a method and apparatus for in-situ solidifying and stabilising a mass of unstable foundation soil. A plasma arc torch is inserted into a drilled and cased hole to a selected depth in a subterranean unstable soil layer. The torch is then energised and the heat generated by the torch melts the soil material close to the hole, to form a pool of melt while more remote sections are baked to a brick-like consistency or dried and strengthened. Upon cooling, the central melted soil material cools to a hard, vitrified column with physical properties equivalent to hard dense rock.

A first disadvantage of this method of solidifying and stabilising unstable foundation soil is that it requires an excessive amount of energy to heat the soil to a relatively high temperature (4000° C. to 7000° C.) to form the plurality of columns from melted soil, making the method not economically viable.

A second disadvantage of the above method of stabilising unstable foundation soil is that it takes a relatively long time to prepare the holes in the soil before the torch is inserted into the hole and energised. After the holes are dug, they are first lined with a tubular heat destructible casing. This makes the method even more uneconomical.

OBJECT OF THE INVENTION

It is accordingly an object of the present invention to provide a method of preparing a foundation structure, a foundation structure prepared by such a method and an apparatus used for preparing such a foundation structure with which the aforesaid disadvantages can be overcome or at least minimised.

SUMMARY OF THE INVENTION

According to a first aspect of the invention there is provided a method of preparing a foundation structure including the steps of:

forming foundation trenches in the ground; and heating the ground defining the trenches sufficiently to irreversibly change the properties of the ground defining the trenches.

The ground may be heated to a temperature above a level where the ground is baked into a brick-like consistency wherein the structural water of crystallisation is removed and any carbonaceous material and Fe is oxidised.

Alternatively, the ground may be heated to a temperature above its vitrification point where mullite ($Al_6Si_2O_{13}$) begins to form.

The ground may be heated to a temperature above 500° C. and below 1600° C. Preferably, the ground is heated to a temperature above 1100° C.

Further according to the invention the method includes the step of pre-treating the ground by adding an additive to the ground, prior to the step of heating.

The step of pre-treating the ground may include the further step of mixing the additive with the ground prior to the formation of the foundation trenches.

In the case where the ground consists primarily of sand, the additive may be potash.

In the case where the ground consists primarily of clay, the additive may be slaked lime.

The foundation structure may be in the form of a grid of intersecting foundation trenches and may be made up of at least two sets of substantially parallel trenches, each trench of each set intersecting at least one trench of the other set, such that a plurality of rectangular pods are formed in the ground between the trenches.

The distance between adjacent parallel trenches of the grid may be from 1 m to 2 m.

The distance between adjacent parallel trenches of the grid may be from 1.3 m to 1.7 m, preferably approximately 1.5 m.

The width of each foundation trench may be from 50 mm to 170 mm, preferably 120 mm to 160 mm and in particular approximately 150 mm.

The vertical distance from the bottom of each trench to the upper surface may be from 300 mm to 1500 mm, preferably 600 mm to 900 mm and in particular approximately 750 mm.

The step of heating the ground may include the step of projecting flames onto the ground defining the bottom surface of the trenches.

The step of heating the ground may include the further step of similarly heating the upper surfaces of the pods.

The step of forming the trenches in the ground may include the step of removing soil from the ground and the method may include the further steps of replacing the removed soil back into the formed and heated trenches until the trenches are filled; and heating at least part of the replaced soil sufficiently to irreversibly change the properties of the soil.

The soil may be introduced into the formed and heated trenches while simultaneously being heated.

Alternatively, the soil may be introduced into the formed and heated trenches and heated steps-wisely until the trenches are filled and heated flush with the upper surface of the ground.

The method may include the even further steps of placing soil over the pods and filled trenches and heating that soil.

The method may include the step of adding reinforcement in the trenches prior to filling and heating the soil introduced into the trenches.

According to a second aspect of the invention there is provided an apparatus for preparing a foundation structure in the form of trenches in the ground, the apparatus comprising heating means arranged in accordance with the layout of the trenches to be formed in the ground, for heating the ground defining the trenches sufficiently to irreversibly change the properties thereof.

The apparatus may include a housing for encapsulating the heating means.

The heating means may include a source of flammable fuel or gas.

The heating means may further include a network of supply passages and a plurality of outlets.

The outlets may be outlet nozzles.

The outlet nozzles may be connected to the source of fuel or gas via the supply passages, the arrangement being such that the fuel or gas is burned so that flames are projected onto the ground via the outlet nozzles, when the apparatus is placed on the ground defining the trenches.

The outlet nozzles may include a first set, a second set, and a third set of outlet nozzles.

The outlet nozzles may be connected to the gas supply passages via secondary supply passages, the arrangement being such that the first set of outlet nozzles project flames onto the bottom surface of the ground defining the trenches, while the second set of outlet nozzles project flames onto upper surfaces of pods formed between the trenches.

The outlet nozzles may further vary in orientation, such that the third set of outlet nozzles project flames onto the ground defining sides of the trenches.

The secondary supply passages may be movable towards and away from the bottom surface of the ground defining the trenches, to accommodate backfilling of the trenches with removed soil whilst the apparatus is in operation.

The apparatus may further include an extraction means for extracting exhaust gases produced by the flames, from the inside of the housing.

The apparatus may further include inlet means for introducing additional air into the housing so as to create an air current inside the housing to aid the burning of the flames and to increase the temperature of the flames.

The apparatus may even further include a plurality of closable openings through which soil may be introduced to fill the trenches, in use. A chute may be connected to each of the openings to direct the introduced soil into the trenches.

The housing may further include heat-insulation material, the arrangement being such that the heat for heating the ground is contained inside the housing, in use.

According to a third aspect of the invention there is provided a foundation structure prepared by the method of the first aspect of the invention and/or by the apparatus according to the second aspect of the invention.

BRIEF DESCRIPTION OF THE DRAWINGS

The invention will now be described further by way of a non-limiting example with reference to the accompanying drawings wherein.

DESCRIPTION OF A PREFERRED EMBODIMENT OF THE INVENTION

Figure 1:
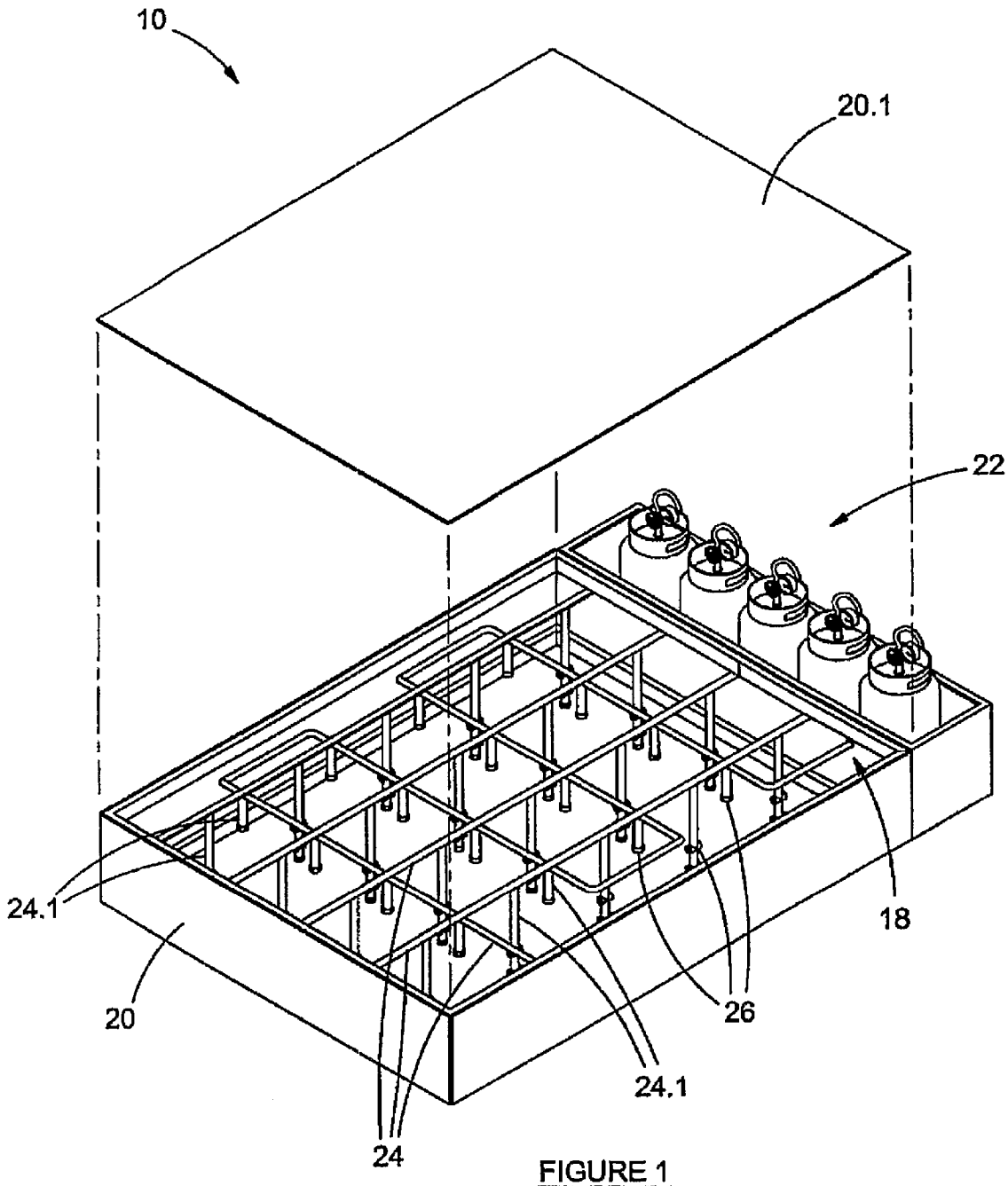
FIG. 1 is a perspective view of an apparatus in accordance with a preferred embodiment of the invention, for preparing a foundation structure in the form of a grid of intersecting trenches in the ground.

Referring to FIG. 1, an apparatus according to a preferred embodiment of the invention for preparing a foundation structure in the form of a grid 12 of intersecting trenches 14 defined or formed in the ground 16, is generally designated by reference numeral 10.

Figure 3:
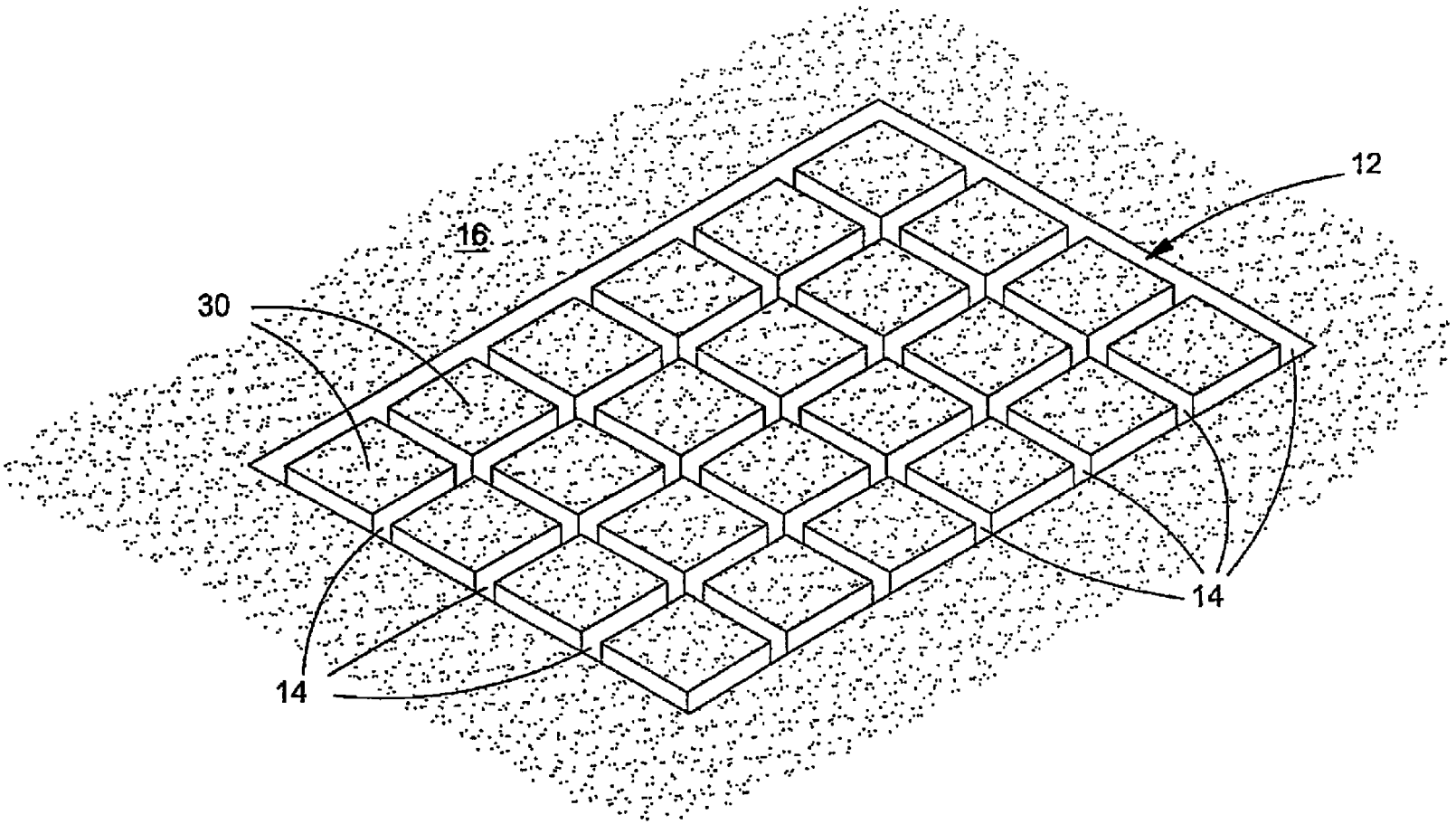
FIG. 3 is a perspective view of the ground defining the grid of intersecting trenches, after being baked by the apparatus shown in FIG. 1.

The apparatus 10 comprises heating means 18 arranged in accordance with the grid 12 (shown in FIG. 3). The apparatus 10 is adapted to heat the ground 16 defining the trenches 14 sufficiently to irreversibly change the properties thereof.

The apparatus 10 includes a housing 20 for encapsulating the heating means 18. In FIG. 1, the housing 20 is shown with a lid 20.1 thereof removed. The housing 20 further includes heat-insulation material (not shown), the arrangement being such that the heat for heating the ground 16 is contained inside the housing 20, in use.

Figure 2:
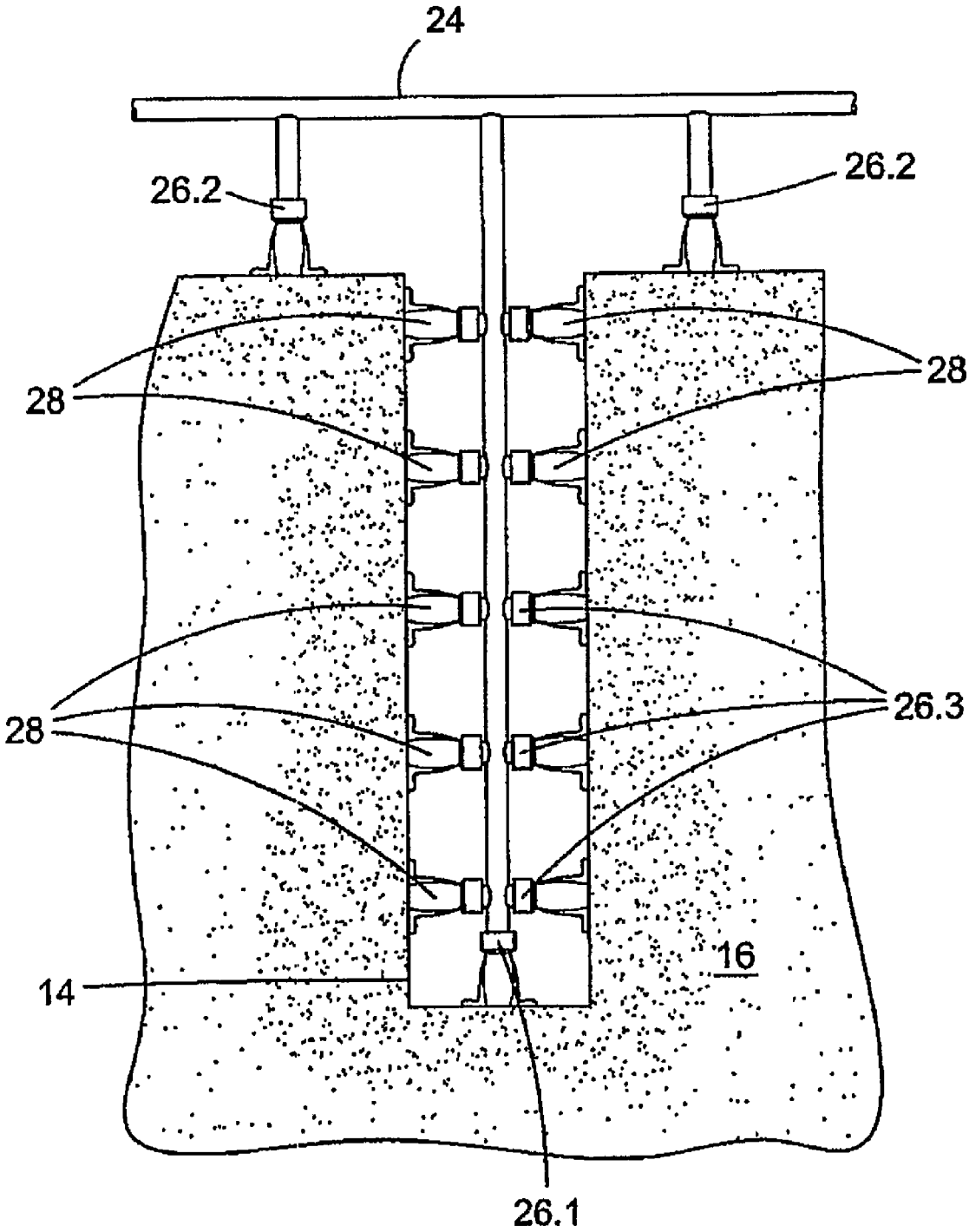
FIG. 2 is a cross-sectional view of a supply passage and outlet nozzles of the apparatus shown in FIG. 1, projecting flames onto the ground defining the grid of trenches, in use.

The heating means 18 includes a source of flammable gas 22; a network of gas supply passages 24; and a plurality of outlets in the form of outlet nozzles 26 arranged in accordance with the grid 12, as shown in FIG. 2.

The outlet nozzles 26 are connected to the source of gas 22 via the gas supply passages 24. In use, the apparatus 10 is positioned on the ground 16 defining the grid 12 of trenches 14, with the outlet nozzles 26 arranged along the trenches 14. The outlet nozzles include a first set 26.1, a second set 26.2 and a third set 26.3 of outlet nozzles.

The outlet nozzles 26 are connected to the gas supply passages 24 via telescopically movable secondary supply passages 24.1. The arrangement is such that the first set of outlet nozzles 26.1 project flames 28 onto the bottom surface of the ground 16 defining the trenches 14, while the second set of outlet nozzles 26.2 project flames 28 onto the upper surfaces of the pods 30 formed between the trenches 14. The outlet nozzles also vary in orientation, such that the third set of outlet nozzles 26.3 project flames 28 onto the ground 16 defining the sides of the trenches 14.

The apparatus 10 further includes an extraction means (not shown) for extracting exhaust gases produced by the flames 28, from the inside of the housing 20, while heating the ground 16. The apparatus 10 further includes inlet means (also not shown) for introducing additional air into the housing 20 so as to create an air current inside the housing 20 to aid the burning of the flames 28. In order to optimise the burning of the flames 28 and thus the temperature inside the housing, fresh air is therefore introduced into the housing 20 via the inlet means and exhaust gases are extracted from the housing 20 via the extraction means.

The apparatus 10 even further includes a plurality of closable openings (not shown) through which soil is introduced into the housing 20 to fill the trenches 14 in the ground 16 underneath the housing 20, in use. A chute (also not shown) is connected to each of the openings to direct the introduced soil into the trenches 14.

In use, the foundation structure is prepared by firstly pretreating the ground 16, which is primarily sand, by adding potash to the ground and mixing it with the ground.

Once the ground has been pre-treated, a grid 12 of intersecting foundation trenches 14 is formed in the ground 16 through conventional methods and by removing soil from the ground 16. The grid 12 of trenches 14 is made up of two sets of substantially parallel trenches 14, each trench 14 of each set intersecting at least one trench 14 of the other set, such that a plurality of rectangular pods 30 are formed in the ground 16 between the trenches 14. The distance between adjacent parallel trenches 14 of the grid is approximately 1.5 m; the width of each foundation trench 14 is approximately 150 mm; and the vertical distance from the bottom of each trench 14 to the flat upper surface is approximately 750 mm.

After the grid 12 of trenches 14 has been formed in the ground 16, flames 28 are projected onto the bottom surface of the ground 16 defining the trenches 14, onto the sides defining the trenches 14 and onto the upper surfaces of the pods 30.

The flames 28 heat the ground 16 sufficiently to irreversibly change the properties of the ground 16 defining the trenches 14. The ground 16 is heated to a temperature of approximately 1100° C. This is a typical temperature at which sand is vitrified to form glass. Above this vitrification point mullite ($Al_6Si_2O_{13}$) begins to form.

Once the grid 12 of trenches 14 has been formed and sufficiently heated in the ground 16, the removed sand is replaced back into the formed and heated trenches 14. The sand is introduced via the openings in the housing 20 and along the chutes to fill the trenches 14 while simultaneously being vitrified. Vitrified sand is introduced into the trenches 14 until the sand fills the trenches 14 and is flush with the ground 16 and forms an integral part of the foundation structure. While the sand is introduced into the trenches 14, the secondary supply passages 24.1 are moved away from the bottom surface of the trenches 14. The arrangement is such that a solid foundation structure is formed, which is suitably strong for supporting a superstructure building. Sand could also be placed over the filled trenches 14 and pods 30 and vitrified to form a floor slab.

In the alternative, in the case where the ground 16 consists primarily of clay, the process of forming the grid 12 of intersecting trenches 14 is similar to that described above. However, in the case of clay, the ground 16 is pre-treated by adding slaked lime prior to the formation of the trenches. The ground 16 is also heated to a temperature of approximately 1100° C., since this temperature is sufficiently high to also irreversibly change the properties of clay. At this temperature the clay is baked to form a brick-like consistency wherein the structural water of crystallisation is removed and any carbonaceous material and Fe is oxidised.

Once the trenches 14 have been formed and baked, they are filled with clay and baked steps-wisely until the trenches 14 are filled completely and are flush with the ground 16; unlike in the case of sand which is a continuous step. This clay is then also baked to form a grid of solid intersecting beams. Reinforcement may be added in the trenches prior to filling them up with clay. The reinforcement is incorporated into the beams, so that a relatively strong foundation structure is formed. Clay may also be placed over the filled trenches 14 and pods 30 and baked to form a floor slab.

The applicant foresees that by heating the ground 16 defining the grid 12 of intersecting trenches 14 with the apparatus 10 according to the invention, an effective method of strengthening the ground 16, for a foundation structure is achieved. The applicant further foresees that since the ground 16 is pre-treated and heated in-situ, the method of preparing the foundation structure is relatively economical and less time consuming than methods of the prior art. This method is especially useful in rural areas where it is relatively difficult and expensive to transport concrete to the site where the foundation structure is to be formed. A further advantage is that the materials needed to form the foundation structure are located on the site i.e. the soil. The method is further environmentally friendly since the soil found at the site is used to form the foundation structure, there are no foreign materials added, except for the additives.

It will be appreciated that variations in detail are possible with method of preparing a foundation structure, a foundation structure prepared by such a method and an apparatus used for preparing such a foundation structure according to the invention without departing from the scope of the appended claims. For example, the foundation structure could also be prepared by forming in the ground 16 a grid of intersecting foundation trenches 14 through conventional methods. Heating means arranged in a grid formation is then introduced into the trenches 14 while simultaneously filling the trenches with sand. The sand introduced into the trenches is therefore heated sufficiently to irreversibly change the structure thereof. Subsequently, a grid of intersecting beams of solid baked soil is formed between the pods 30.

Furthermore, the foundation trenches do not need to be in the form of a grid of intersecting trenches. Various different layouts of foundation trenches are possible, since the arrangement of the heating means may be varied for a particular need.

The invention claimed is:

1. A method of preparing a foundation structure including the steps of:

forming foundation trenches in the ground; and heating the ground defining the trenches sufficiently to irreversibly change the properties of the ground defining the trenches;

wherein the foundation structure is in the form of a grid of intersecting foundation trenches and are made up of at least two sets of substantially parallel trenches, each trench of each set intersecting at least one trench of the other set, such that a plurality of rectangular pods are formed in the ground between the trenches.

2. A method according to claim 1 wherein the ground is heated to a temperature above a level where the ground is baked into a brick-like consistency wherein the structural water of crystallisation is removed and any carbonaceous material and Fe is oxidised.

3. A method according to claim 1 wherein the ground is heated to a temperature above its vitrification point where mullite ($Al_6Si_2O_{13}$) begins to form.

4. A method according to claim 1 wherein the ground is heated to a temperature above 500° C. and below 1600° C.

5. A method according to claim 4 wherein the ground is heated to a temperature above 1100° C.

6. A method according to claim 1 which includes the further step of pre-treating the ground by adding an additive to the ground, prior to the step of heating.

7. A method according to claim 6 wherein the step of pre-treating the ground includes the further step of mixing the additive with the ground prior to the formation of the foundation trenches.

8. A method according to claim 6 wherein, in the case where the ground consists primarily of sand, the additive is potash.

9. A method according to claim 6 wherein, in the case where the ground consists primarily of clay, the additive is slaked lime.

10. A method according to claim 1 wherein the distance between adjacent parallel trenches of the grid is from 1 m to 2 m.

11. A method according to claim 10 wherein the distance between adjacent parallel trenches of the grid is from 1.3 m to 1.7 m.

12. A method according to claim 11 wherein the distance between adjacent parallel trenches of the grid is 1.5 m.

13. A method according to claim 1 wherein the width of each foundation trench is from 50 mm to 170 mm.

14. A method according to claim 13 wherein the width of each foundation trench is from 120 mm to 160 mm.

15. A method according to claim 14 wherein the width of each foundation trench is 150 mm.

16. A method according to claim 1 wherein the vertical distance from the bottom of each trench to the upper surface is from 300 mm to 1500 mm.

17. A method according to claim 16 wherein the vertical distance from the bottom of each trench to the upper surface is from 600 mm to 900 mm.

18. A method according to claim 17 wherein the vertical distance from the bottom of each trench to the upper surface is 750 mm.

19. A method according to claim 1 wherein the step of heating the ground includes the step of projecting flames onto the ground defining the bottom surface of the trenches.

20. A method according to claim 19 wherein the step of heating the ground includes the further step of similarly heating the upper surface of the pods.

21. A method according to claim 20 wherein the step of forming the trenches in the ground includes the step of removing soil from the ground and the method includes the further steps of replacing the removed soil back into the formed and heated trenches until the trenches are filled; and heating at least part of the replaced soil sufficiently to irreversibly change the properties of the soil.

22. A method according to claim 21 wherein the soil is introduced into the formed and heated trenches while simultaneously being heated.

23. A method according to claim 21 wherein the soil is introduced into the formed and heated trenches and heated steps-wisely until the trenches are filled and heated flush with the upper surface of the ground.

24. A method according to claim 21 which includes the even further steps of placing soil over the pods and filled trenches and heating that soil.

25. A method according to claim 21 which includes the step of adding reinforcement in the trenches prior to filling and heating the soil introduced into the trenches.

26. A foundation structure prepared by the method of claim 1.

27. An apparatus for preparing a foundation structure in the form of trenches in the ground, the apparatus comprising heating means arranged in accordance with the layout of the trenches to be formed in the ground, for heating the ground defining the trenches sufficiently to irreversibly change the properties thereof:

wherein the foundation structure is in the form of a grid of intersecting foundation trenches and are made up of at least two sets of substantially parallel trenches, each trench of each set intersecting at least one trench of the other set, such that a plurality of rectangular pods are formed in the ground between the trenches.

28. An apparatus according to claim 27 which includes a housing for encapsulating the heating means.

29. An apparatus according to claim 27 wherein the heating means includes a source of flammable fuel or gas.

30. An apparatus according to claim 27 wherein the heating means further includes a network of supply passages and a plurality of outlets.

31. An apparatus according to claim 30 wherein the outlets are outlet nozzles.

32. An apparatus according to claim 31 wherein the outlet nozzles are connected to the source of fuel or gas via the supply passages, the arrangement being such that the fuel or gas is burned so that flames are projected onto the ground via the outlet nozzles, when the apparatus is placed on the ground defining the trenches.

33. An apparatus according to claim 32 wherein the outlet nozzles include a first set, a second set, and a third set of outlet nozzles.

34. An apparatus according to claim 33 wherein the outlet nozzles are connected to the gas supply passages via secondary supply passages, the arrangement being such that the first set of outlet nozzles project flames onto the bottom surface of the ground defining the trenches, while the second set of outlet nozzles project flames onto upper surfaces of pods formed between the trenches.

35. An apparatus according to claim 34 wherein the outlet nozzles further vary in orientation, such that the third set of outlet nozzles project flames onto the ground defining sides of the trenches.

36. An apparatus according to claim 35 wherein the secondary supply passages are movable towards and away from the bottom surface of the ground defining the trenches, to accommodate backfilling of the trenches with removed soil whilst the apparatus is in operation.

37. An apparatus according to claim 28 which includes an extraction means for extracting exhaust gases produced by the flames, from the inside of the housing.

38. An apparatus according to claim 28 which further includes inlet means for introducing additional air into the housing and to create an air current inside the housing to aid the burning of the flames and to increase the temperature of the flames.

39. An apparatus according to claim 28 wherein the housing further includes heat-insulation material, the arrangement being such that the heat for heating the ground is contained inside the housing, in use.

40. An apparatus according to claim 27 which includes a plurality of closable openings through which soil is introduced to fill the trenches, in use.

41. An apparatus according to claim 40 which includes a chute connected to each of the openings to direct the introduced soil into the trenches.

* * * * *